US006394627B1

(12) United States Patent
Lo

(10) Patent No.: US 6,394,627 B1
(45) Date of Patent: May 28, 2002

(54) CUTLERY BASE WITH BUILT-IN ILLUMINATION EQUIPMENT

(76) Inventor: Li-hsueh Lo, 4F., No. 7, 5 Alley, 257 Lane, Jyi-Lih St., Peitou Zone, Taipei (TW)

( * ) Notice: Subject to any disclaimer, the term of this patent is extended or adjusted under 35 U.S.C. 154(b) by 0 days.

(21) Appl. No.: 09/765,328

(22) Filed: Jan. 22, 2001

(51) Int. Cl.[7] ..... F21V 38/00; F21W 131/30

(52) U.S. Cl. ..... 362/253; 362/367; 362/154; 362/127

(58) Field of Search ..... 362/367, 154, 362/127, 132, 133, 134, 253, 96

(56) References Cited

U.S. PATENT DOCUMENTS 5,540,719 A * 7/1996 Covelli-Ingwell et al. .. 362/154 X
5,615,941 A * 4/1997 Shecter ..... 362/154 X
5,649,525 A * 7/1997 Koepf ..... 362/253 X
6,305,826 B1 * 10/2001 Yang ..... 362/376 X

* cited by examiner

*Primary Examiner*—Laura K. Tso
(74) *Attorney, Agent, or Firm*—Troxell Law Office PLLC

(57) ABSTRACT

A cutlery base with built-in illumination equipment. The cutlery base has formed in its top end a plurality of insertion slots that provide for ensheathing cutlery and, furthermore, the cutlery base has an opening formed in at least one of its lateral surfaces that is contiguous with the insertion slots and a translucent component is inserted into the opening of the cutlery base. The cutlery base has conjoined to its bottom end a footing of a matching shape and an illuminant is installed inside the footing. Covering the contact surfaces between the said footing and the cutlery base is a translucent waterproof hood. During utilization, the light rays emitted by the illuminant inside the footing penetrate the translucent waterproof hood and are projected into the cutlery base and then are projected outward through the translucent component of the cutlery base. As such, not only does the present invention function as guiding night lamp, it also enables reaching a correct position to prevent persons entering the kitchen during darkness from contacting the cutlery in the cutlery base and thereby precludes unnecessary danger.

6 Claims, 4 Drawing Sheets

CUTLERY BASE WITH BUILT-IN ILLUMINATION EQUIPMENT

BACKGROUND OF THE INVENTION

1) Field of the Invention

The invention herein relates to a cutlery base with built-in illumination equipment, wherein an illuminant is installed at the lower extent of the cutlery base and the cutlery base has a translucent component inserted into at least one lateral surface such that the illuminant projects light towards the translucent component on the cutlery base. This enables the cutlery base to not only be capable of ensheathing cutlery, but also allows it to function as a night lamp that indicates its position in darkness to prevent accidental contact by persons.

2) Description of the Prior Art

Conventional cutlery bases are typically rectangular blocks having a certain angle of inclination. The flat surface at the top end of the said blocks are step contoured, with said flat surfaces having a plurality of crossed slots, the said slots extending into the blocks. When such structures are utilized, the slots formed therein enable the insertion of various cutlery into the different slots and allow the storage of the cutlery until the user needs to remove them for use. Other than that, they have no other function. Furthermore, since such cutlery bases are of a fixed height, cutlery of greater length cannot be completely inserted into the slots; as such, people in the kitchen at night groping for the light switch in the darkness often mistakenly touch the cutlery in the cutlery block, a situation in which cuts and other dangerous events may occur.

To improve the various shortcomings of the said conventional cutlery bases, the inventor of the invention herein conducted extensive research and continuous experimentation that culminated in the successful development of the cutlery base with built-in illumination equipment of the invention herein; the said cutlery base has formed in its top end a plurality of insertion slots that provide for the ensheathing of cutlery and, furthermore, the said cutlery base has formed in at least one of its lateral surfaces an opening that is contiguous to the insertion slots, with a translucent component inserted into the said opening; furthermore, the said cutlery base has conjoined to its bottom end a footing of a matching shape and an illuminant is installed inside the said footing; and covering the contact surfaces between the said footing and the cutlery base is a translucent waterproof hood.

SUMMARY OF THE INVENTION

One objective of the invention herein is to provide a cutlery base with built-in illumination equipment in which the said cutlery block structure enables the light rays emitted by an illuminant inside a footing to penetrate a translucent waterproof hood such that light is projected outward through the translucent component on a lateral side the cutlery base, thereby guiding people in a dark kitchen and enabling them to reach a correct position or required article.

Another objective of the invention herein is to provide a cutlery base with built-in illumination equipment in which the said cutlery base structure is illuminated and since the position of the cutlery base position is indicated, this prevents persons entering the kitchen during darkness from contacting the cutlery in the cutlery base, thereby achieving the objective of assuring personal safety.

Still another objective of the invention herein is to provide a cutlery base with built-in illumination equipment in which the said translucent component on the lateral side of the cutlery base can be graphically embellished with different patterns such that when the illuminant of the footing projects light through the translucent component, the pattern on the translucent component is reflected from the outer periphery of the cutlery base and as such, not only is the appearance of the cutlery base enhanced, the light rays reflecting from the cutlery base never become uninteresting because the degree of light ray transformation is intensified.

To enable the examination committee to further understand the form, structure, and function of the present invention, the preferred embodiment thereof is accompanied by the brief description of the drawings below and followed by the detailed description of the invention herein.

DETAILED DESCRIPTION OF THE INVENTION

Figure 1:
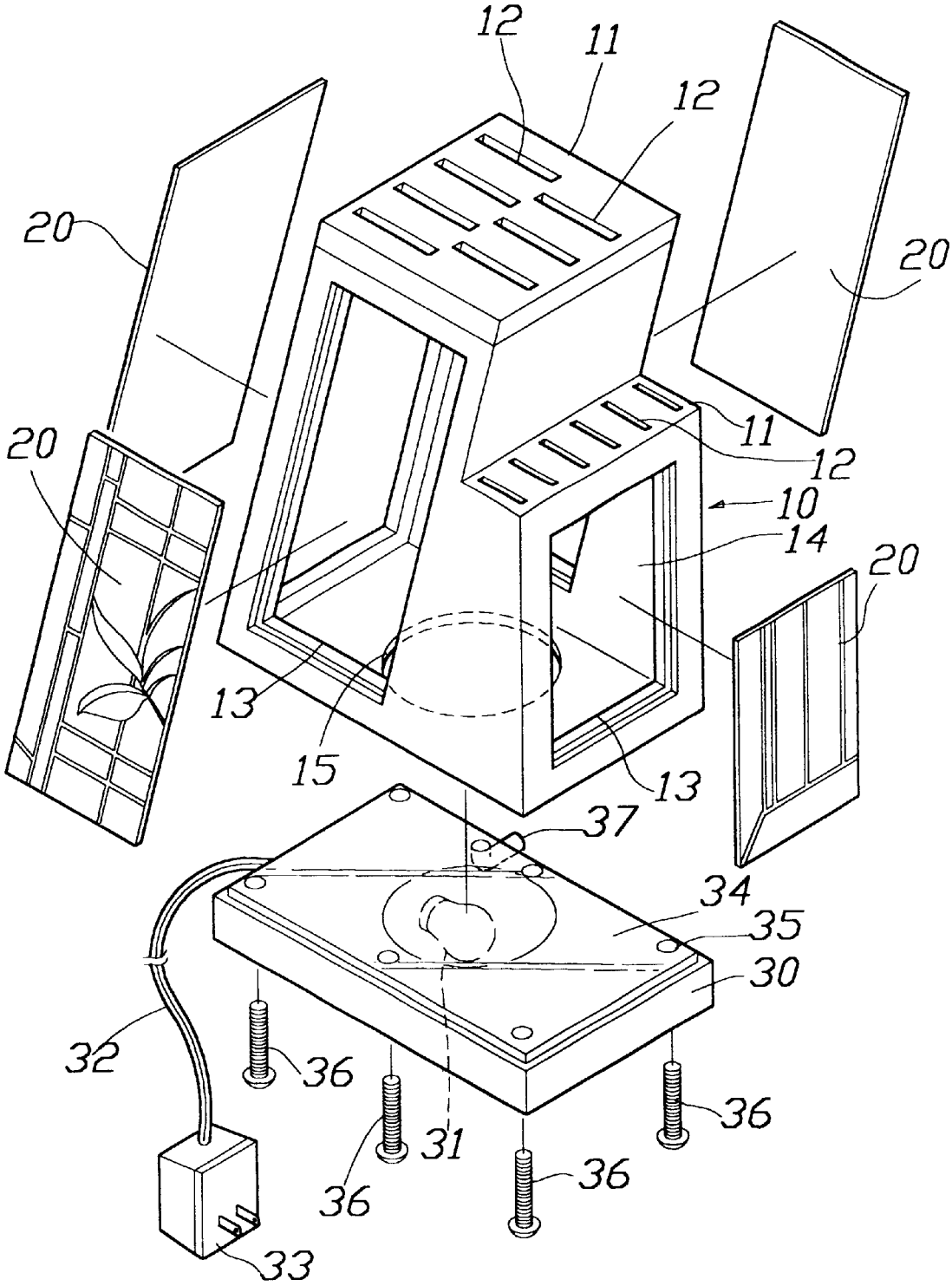
FIG. 1 is an exploded drawing of the invention herein.
Figure 2:
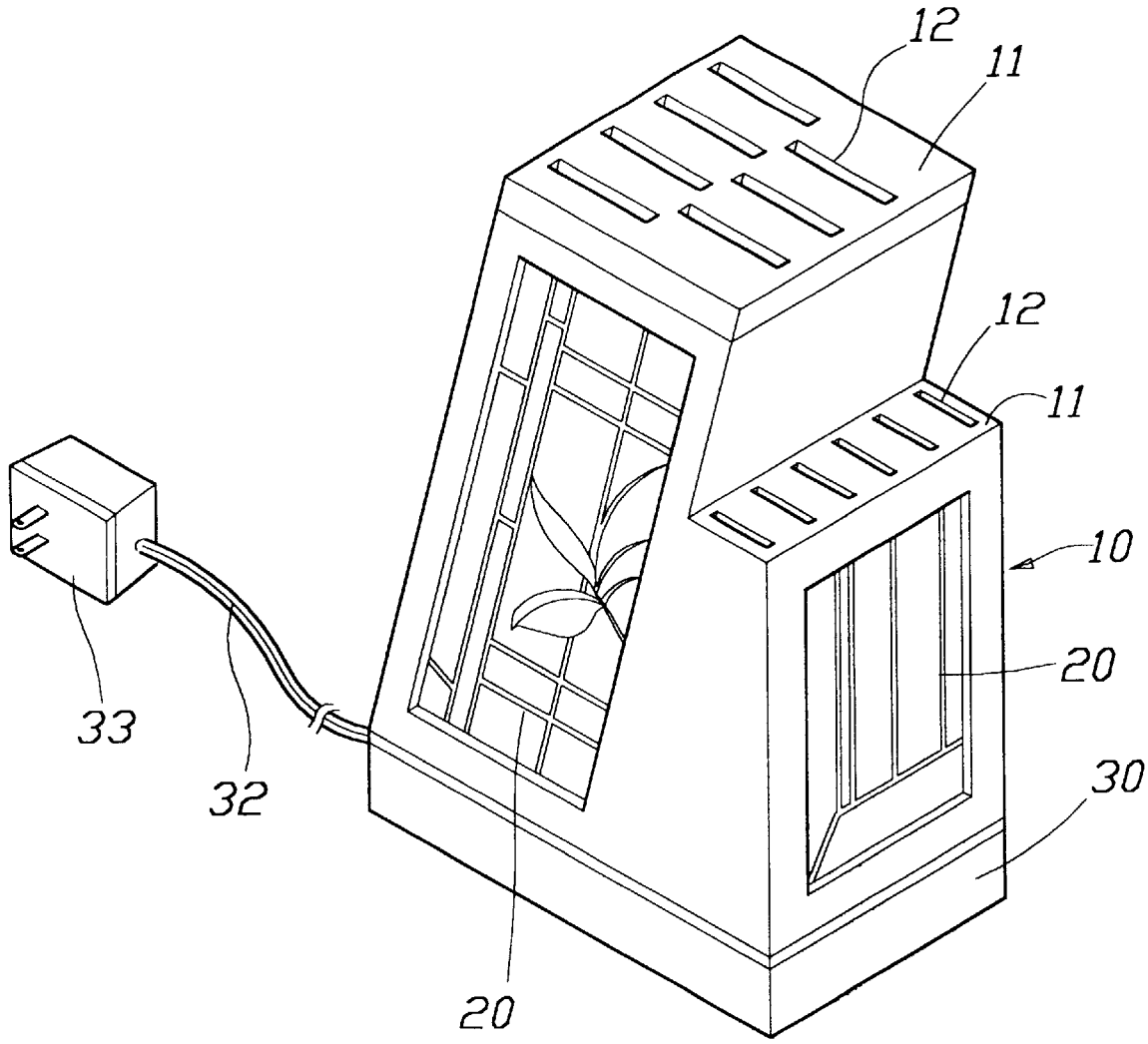
FIG. 2 is an isometric drawing of the invention herein.
Figure 3:
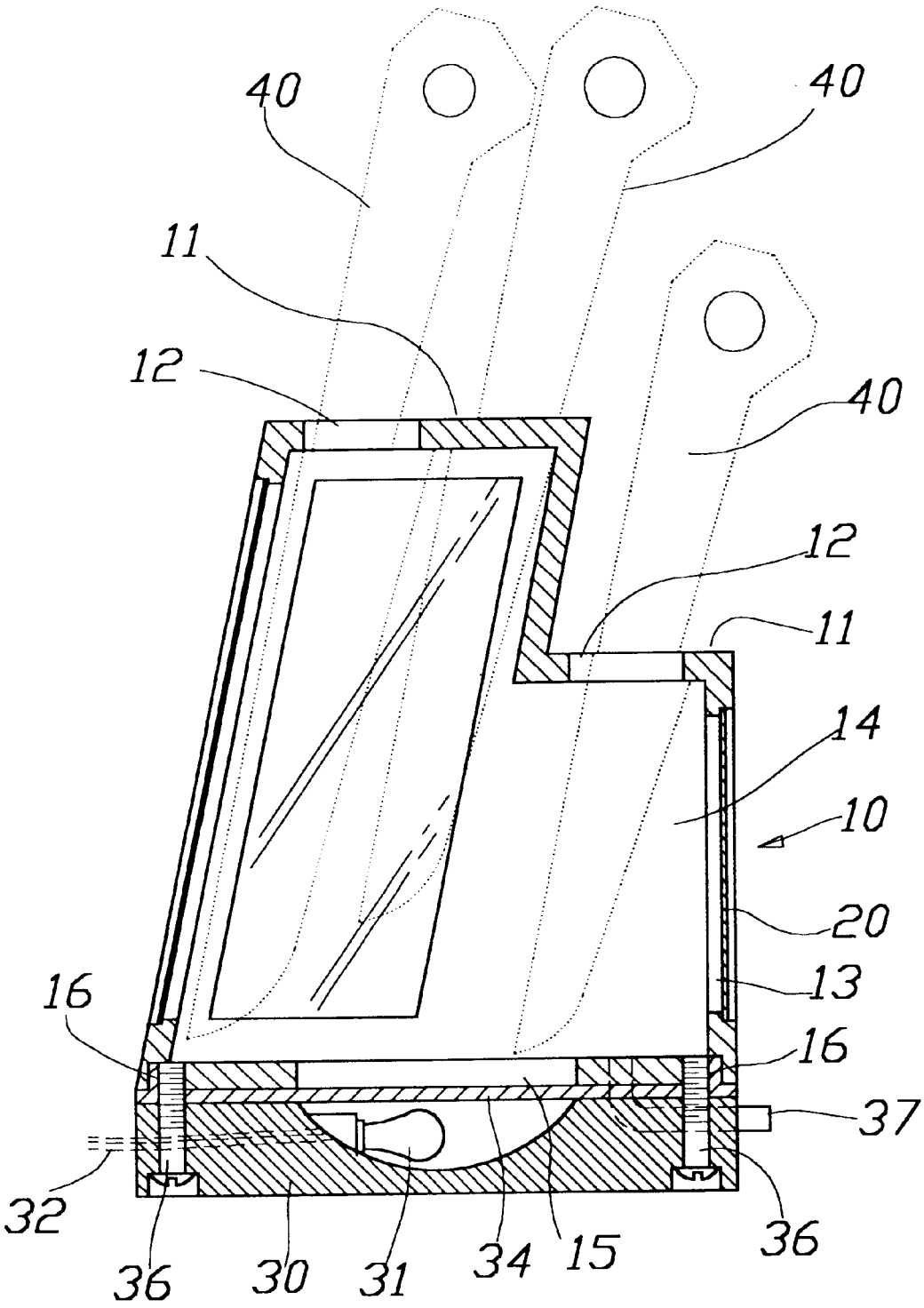
FIG. 3 is a cross-section drawing of the invention herein during utilization.
Figure 4:
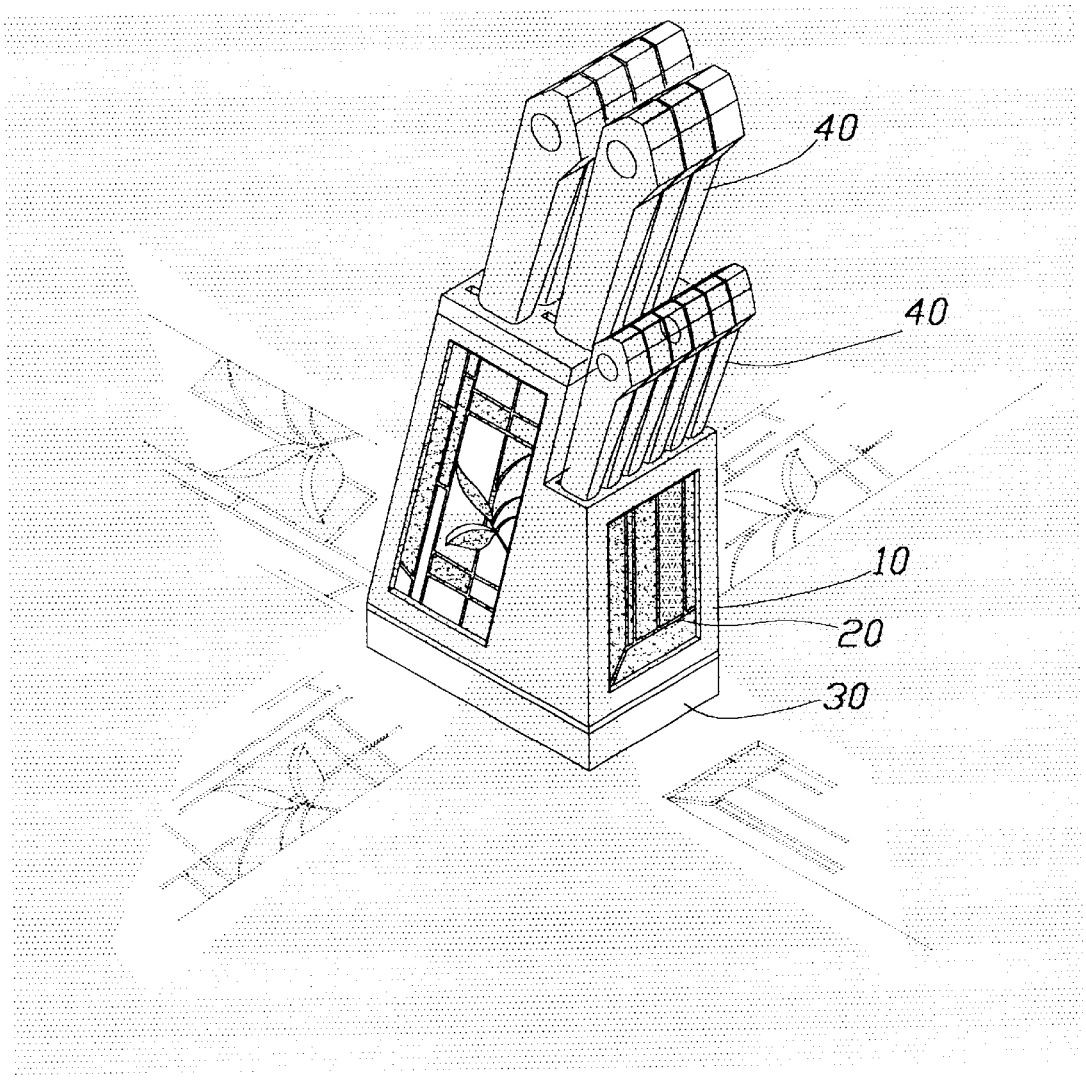
FIG. 4 is an isometric drawing of the invention herein during utilization.

Referring to FIG. 1 and FIG. 2, in the cutlery base with built-in illumination equipment of the invention herein, the said cutlery base 10 is of a certain angle of inclination and, furthermore, of a rectangular framework (however, those familiar with the related technology can still substitute another shape in its place); moreover, the top surface of the said cutlery base 10 is of a stepped arrangement and, furthermore, each of the level surfaces 11 have a certain difference in height and each of the level surfaces 11 have one or more insertion slots 12 for the ensheathing of different cutlery 40 (as shown in FIG. 3 and FIG. 4).

In addition, as indicated in FIG. 1, FIG. 2 and FIG. 3, the said cutlery base 10 has an opening 13 formed in each of its lateral surfaces and each of the said openings 13 is contiguous with a space 14 in the cutlery base 10 holding the cutlery 40 and, furthermore, a translucent component 20 is inserted over each of the said openings 12, which in the embodiment of the invention herein consists of a transparent panel (however, those familiar with the related technology can still substitute another component in its place) and the surfaces of the said translucent components 20 can be graphically embellished with different patterns or colors as per requirements to enhance the visibility and variation of the translucent components 20.

The said cutlery block 10 has formed in its bottom end a translucence hole 15 that is contiguous with the space 14 and, furthermore, the cutlery base 10 is stacked on a footing 30 that matches its shape, which in the embodiment of the invention herein consists of a polyvinyl chloride (PVC) fabricated box (however, those familiar with the related technology can still substitute another component in its place) and installed in the center section of the said footing 30 is an illuminant 31, which in the embodiment of the invention herein consists of a light bulb (however, those familiar with the related technology can still substitute another component in its place), the said illuminant 31 is connected to a circuit 32 and a plug 33 such that during utilization, the plug 33 is placed in continuity with a power source so the illuminant 31 emits light and, furthermore, a translucent waterproof hood 34 covers the contact surfaces between the said footing 30 and the bottom end of the cutlery base 10, which in the embodiment of the invention herein is a transparent flat plate (however, those familiar with the related technology can still substitute another component in its place) that not only prevents the entry of water and air from the outside into the footing 30, but also allows the light rays emitted by the illuminant 31 inside the footing 30 to penetrate the translucent waterproof hood 34 and fully project outward (as shown in FIG. 3) and, furthermore, in the outer periphery at the bottom end of the said cutlery base 10 and the footing 30 are one or more aligned screw holes 16 and 35 (as shown in FIG. 3 and FIG. 1), enabling the insertion of screws 36 through the screw holes 16 and 35 to fasten the said footing 30 and the cutlery base 10 into a single structural entity (as shown in FIG. 2 and FIG. 3) (however, those familiar with the related technology can still substitute another component in its place).

Furthermore, as indicated in FIG. 1, the footing 30 has extending laterally at its periphery a recessed groove 37 such that when water drips from the surface of cutlery 40 in the cutlery base 10 onto the waterproof hood 34 of the footing 30 (as indicated in FIG. 3), the groove 37 directs the flow outside to prevent accumulation inside the cutlery base 10.

During utilization, as indicated in FIG. 2, FIG. 3, and FIG. 4, the plug 33 is inserted into the power source switch (not shown in the drawings) so electric current from the circuit 32 is conducted to the illuminant 31 inside the footing 30, enabling the said illuminant to emit light rays through the waterproof hood 34 and translucence hole 15 of the footing 30 and, furthermore, project toward the translucent components 20 on the cutlery base 10 and then project through the translucent components 20; similar to a night lamp that guides people in a dark kitchen, this enables them to reach a correct position or a required article and since the position of the cutlery base 10 is indicated, this prevents persons entering the kitchen during darkness from contacting the cutlery 40 in the cutlery base 10, thereby achieving the objective of assuring personal safety; furthermore, when the illuminant 31 of the footing 30 projects light through the translucent components 20, the patterns on the translucent components 20 are reflected from the outer periphery of the cutlery base 10 and as such, not only is the appearance of the cutlery base 10 enhanced, but the light rays reflecting from the cutlery base 10 never become uninteresting because the degree of light ray transformation in intensified (as shown in FIG. 4).

The said description of the most preferred embodiment of the invention herein only serves as a demonstrative example, and all modifications and adaptations by individuals familiar with the technology shall remain within the spirit and claims of the present invention.

In summation of the foregoing section, since the cutlery base with built-in illumination equipment of the invention herein is an innovative invention in terms of material form, structure, and construction as well as original, capable of additional functionality and, furthermore, is practical, the present invention herein is an ideal new invention.

What is claimed is:

1. A cutlery base with built-in illumination equipment; the said structure is comprised of:

A cutlery base, the said cutlery base has insertion slots formed in one surface to provide for the ensheathing of cutlery, with a translucence hole formed in the surface opposite from the surface with the said insertion slots and, furthermore, the said cutlery base has an opening formed in at least one of its lateral surfaces and the said opening, a space in the said cutlery base, and the said translucence hole are contiguous, A translucent component inserted into the said opening of the said cutlery base, A footing that is stacked on the surface opposite to that of the said cutlery base insertion slots, the said footing has installed at its center section an illuminant connected to a power source and, furthermore, the said footing has covering the contact surfaces between itself and the said cutlery base a translucent waterproof hood that not only prevents the entry of water and air from the outside into the said footing, but also allows the light rays emitted by the said illuminant inside the footing to penetrate the said translucent waterproof hood and fully project outward, Given the said structural components, during utilization the light rays emitted by the said illuminant inside the said footing penetrate the said translucent waterproof hood and are projected into the said cutlery base and then are projected outward through the said translucent component of the said cutlery base; as such, not only does the present invention function as guiding night lamp, it also enables reaching a correct position to prevent persons entering the kitchen during darkness from contacting the said cutlery in the said cutlery base and thereby precludes unnecessary danger.

2. As mentioned in claim 1 of the cutlery base with built-in illumination equipment of the invention herein, in the surfaces of contact between the said cutlery base and the outer periphery of the said footing are one or more aligned screw holes, enabling the insertion of screws through the said screw holes to fasten the said cutlery base into a single structural entity.

3. As mentioned in claim 1 of the cutlery base with built-in illumination equipment of the invention herein, the surface of the said translucent component can be graphically embellished with different patterns or colors.

4. As mentioned in claim 1 of the cutlery base with built-in illumination equipment of the invention herein, the said translucent component can be a transparent panel.

5. As mentioned in claim 1 of the cutlery base with built-in illumination equipment of the invention herein, the said translucent waterproof hood can be transparent flat plate.

6. As mentioned in claim 1 of the cutlery base with built-in illumination equipment of the invention herein, the said footing has extending laterally at its periphery a recessed groove such that when water drips from the surface of the said cutlery in the said cutlery base onto the said waterproof hood of the said footing, the said groove directs the flow outside to prevent accumulation inside the said cutlery base.

* * * * *